US010207838B1

(12) United States Patent
Morrison

(10) Patent No.: US 10,207,838 B1
(45) Date of Patent: Feb. 19, 2019

(54) CORNERPOST SUPPORT

(71) Applicant: INTERNATIONAL PAPER COMPANY, Memphis, TN (US)

(72) Inventor: Sean M. Morrison, Lakeland, FL (US)

(73) Assignee: INTERNATIONAL PAPER COMPANY, Memphis, TN (US)

( * ) Notice: Subject to any disclaimer, the term of this patent is extended or adjusted under 35 U.S.C. 154(b) by 0 days.

(21) Appl. No.: 15/848,192

(22) Filed: Dec. 20, 2017

(51) Int. Cl.
*B65D 81/02* (2006.01)
*B65D 5/50* (2006.01)

(52) U.S. Cl.
CPC ..... *B65D 5/5033* (2013.01)

(58) Field of Classification Search
USPC ..... 206/586, 453, 591, 594, 592
See application file for complete search history.

(56) References Cited

U.S. PATENT DOCUMENTS 1,585,684 A * 5/1926 Oppenheim ..... B65D 5/505 206/521
2,733,851 A * 2/1956 Van Ness ..... B65D 5/5033 206/319
2,808,978 A * 10/1957 Wright ..... B65D 5/505 206/320
2,857,045 A * 10/1958 Foote ..... B65D 5/4204 206/784
4,360,145 A * 11/1982 Wilcox ..... B65D 81/107 206/521
7,458,465 B1 * 12/2008 Dahl ..... B65D 5/5052 206/521
2004/0206657 A1 * 10/2004 Yokawa ..... B65D 5/5035 206/523
2008/0067106 A1 * 3/2008 Kuo ..... B65D 5/505 206/588
2011/0290692 A1 * 12/2011 Spivey, Sr. ..... B65D 71/36 206/433
2013/0008812 A1 * 1/2013 Swart ..... B65D 5/0281 206/320

* cited by examiner

*Primary Examiner* — Jacob K Ackun
(74) *Attorney, Agent, or Firm* — Thomas W. Ryan; Michael D. Folkerts

(57) ABSTRACT

A packaging insert formed from a one-piece blank including a main body panel having opposing first and second longitudinal edges and opposing first and second lateral edges. The folded blank further includes a pair of column panels, each column panel including a first side panel, a front panel, a second side panel, and an overlap tab connected to the lateral edges of the main body panel in series at first, second, third, and fourth lateral score lines. The front panel of each column panel is folded about a respective second lateral score line with the overlap tab overlapping and attached to the main body panel. Each column panel can be erected to form a rectangular column adjacent to each of the lateral edges of the main body panel.

17 Claims, 6 Drawing Sheets

CORNERPOST SUPPORT

FIELD OF THE INVENTION

The present invention relates to improvements in packaging inserts and, more particularly, to a packaging insert configured to provide a cornerpost support in a container such as a paperboard box.

BACKGROUND OF THE INVENTION

Products shipped within containers or boxes may require various forms of packing to retain the product in a desired position within the box. For example, during shipment of relatively heavy products, such as lawn mowers, changes in the orientation of the box or dropping of the box could cause damage to elements of the product. In the case of shipping walk-behind lawn mowers, particular areas of concern revolve around damage to wheels, height adjusters and handles. Known solutions have included individual packing elements that can be provided at the particular locations of concern to provide bracing and/or cushioning. However, such individual packing elements may be subject to deformation or fail to provide a sufficiently rigid structure for maintaining the product in position in the event that the box containing the product is subjected to rough handling during shipping.

SUMMARY OF THE INVENTION

In accordance with an aspect of the invention, a packaging insert formed from a blank is provided. The packaging insert blank includes a main body panel and a pair of column panels connected to the main body panel along respective first lateral score lines. Each column panel includes a first side panel, a front panel, and a second side panel connected in series at respective second and third lateral score lines. The packaging insert comprises a central panel section defined by the main body panel, first and second rectangular columns defined by the column panels at opposing lateral sides of the central panel section. Each rectangular column includes a back wall formed by a portion of the main body panel, a first side wall defined by the first side panel folded generally perpendicular to the main body panel at the respective first lateral score line, a front wall defined by the front panel folded generally perpendicular to the first side wall at the respective second lateral score line, and a second side wall defined by the second side panel folded generally perpendicular to the front wall at the respective third lateral score line and connected to the main body panel.

The back wall of each rectangular column may be coplanar with the central panel section.

The blank may further include an overlap tab connected to each of the second side panels at respective fourth lateral score lines, and each overlap tab may be fastened to a location on the main body panel.

The central panel section may have a lateral dimension that is defined by a portion of the main body panel extending from the second side wall of the first rectangular column to the second side wall of the second rectangular column.

The main body panel may have a first longitudinal edge and an opposed second longitudinal edge defining a longitudinal dimension of the packaging insert, the front wall may have opposed first and second longitudinal edges extending parallel to the longitudinal edges of the main body panel, and the second longitudinal edge of the front wall may be longitudinally displaced from the second longitudinal edge of the main body panel.

The second side wall of each rectangular column may have opposed first and second longitudinal edges, and the second longitudinal edge of the second side wall may be longitudinally displaced from the second longitudinal edge of the main body panel and may be longitudinally displaced from the second longitudinal edge of the front wall.

In accordance with another aspect of the invention, a blank for forming a one-piece packaging insert is provided. The blank for forming the one-piece packaging insert comprises a main body panel having a first longitudinal edge defining a first longitudinal edge of the blank and an opposing second longitudinal edge defining a second longitudinal edge of the blank, and opposing first and second lateral edges. A pair of column panels are connected to the main body panel along respective first lateral score lines, and each column panel defines structure for forming a rectangular column adjacent to the opposing first and second lateral edges of the main body panel. Each column panel includes a first side panel, a front panel, and a second side panel connected in series along respective second and third lateral score lines.

An overlap tab may be connected to each of the second side panels at respective fourth lateral score lines, and each overlap tab may define a lateral edge of the blank.

Each first side panel has a lateral dimension, from the first lateral score line to the second lateral score line, and the lateral dimension of the first side panel may be equal to a lateral dimension of the second side panel, from the third lateral score line to the fourth lateral score line.

Each front panel includes a longitudinal dimension extending from a first longitudinal edge to a second longitudinal edge, and the longitudinal dimension of each front panel may be less than a longitudinal dimension of the main body panel extending between the first and second longitudinal edges of the main body panel.

At least a portion of the first longitudinal edge of each front panel may be longitudinally aligned with the first longitudinal edge of the main body panel, and the second longitudinal edge of each front panel may be longitudinally displaced from alignment with the second longitudinal edge of the main body panel.

At least a portion of each of the first and second longitudinal edges of each front panel may be longitudinally displaced from the respective first and second longitudinal edges of the main body panel, and the longitudinally displaced portions of the first longitudinal edge of the front panels may define slots in the front panels.

Each second side panel includes a longitudinal dimension extending from a first longitudinal edge to a second longitudinal edge, and the longitudinal dimension of each second side panel may be less than the longitudinal dimension of the main body panel and may be greater than a longitudinal dimension of the front panel.

Each second side panel includes a longitudinal dimension extending from a first longitudinal edge to a second longitudinal edge, and the longitudinal dimension of each second side panel may be less than a longitudinal dimension of the main body panel extending between the first and second longitudinal edges of the main body panel.

The first longitudinal edge of each second side panel may be longitudinally aligned with the first longitudinal edge of the main body panel, and the second longitudinal edge of each second side panel may be longitudinally displaced from alignment with the second longitudinal edge of the main body panel.

In accordance with a further aspect of the invention, a folded blank for forming a packaging insert is provided. The folded blank comprises a one-piece blank including a main body panel having opposing first and second longitudinal edges and opposing first and second lateral edges. The folded blank further includes a pair of column panels, each column panel including a first side panel, a front panel, a second side panel, and an overlap tab connected to the main body panel in series at first, second, third, and fourth lateral score lines. The front panel of each column panel is folded about a respective second lateral score line with the overlap tab overlapping and attached to the main body panel.

Each front panel may be positioned in overlapping relation with a respective first side panel and each second side panel may be positioned in overlapping relation with a portion of the main body panel.

Each overlap tab may be adhered to a manufacturer's joint strip defined on the main body panel.

Each front panel includes a longitudinal dimension extending from a first longitudinal edge to a second longitudinal edge, and the longitudinal dimension of each front panel may be less than a longitudinal dimension of the main body panel extending between the first and second longitudinal edges of the main body panel.

Each second side panel includes a longitudinal dimension extending from a first longitudinal edge to a second longitudinal edge, and the longitudinal dimension of each second side panel may be less than the longitudinal dimension of the main body panel and may be greater than the longitudinal dimension of the front panel.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

The present description is directed to a packaging insert that can be provided as a cornerpost support in a container, such as a box, for retaining a product in position and additionally providing structural support to the container. The described packaging insert can be constructed on available container forming machinery, and can be formed from a blank that is processed either with processing machinery equipment designed for this purpose or by hand. For example, the blank may be processed in a single pass through flexo-folder-gluer machinery to produce a glued, folded blank that can subsequently be opened or erected for use in a packaging process. As may be understood from the following description, the packaging insert described herein can be used to facilitate packaging a product, wherein the packaging insert could be shipped to a user or customer in a folded configuration and quickly configured into an erected configuration for use in a process for packing a product in a container such as a shipping box.

Figure 1:
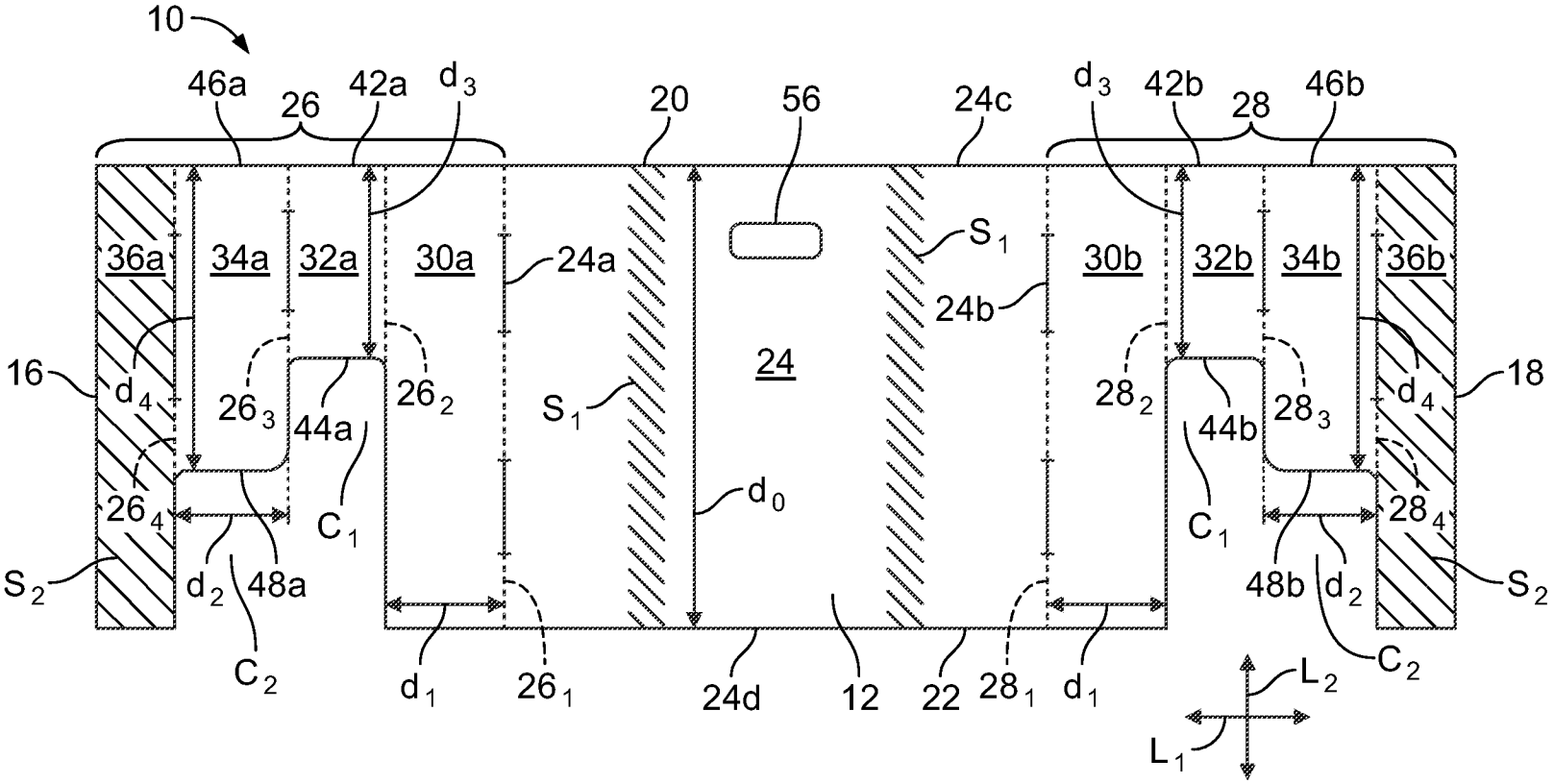
FIG. 1 is a plan view of a blank for forming a packaging insert.
Figure 3:
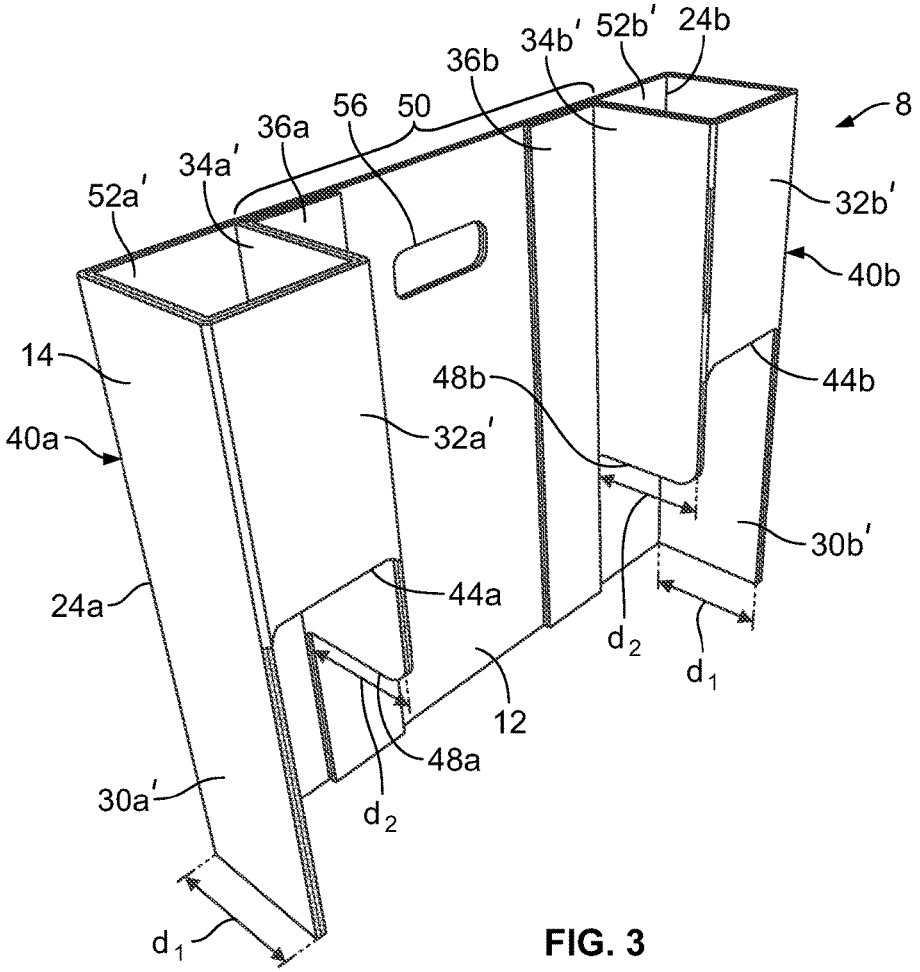
FIG. 3 is a perspective view of an erected packaging insert formed from the blank of FIG. 1.

Referring to FIG. 1, a die cut blank 10 is shown for illustrating one or more aspects of the packaging insert described herein. In a use of the blank 10 to form a packaging insert 8, see FIG. 3, the blank 10 may be die cut to the shape shown herein and may be formed of a paperboard material, such as a corrugated cardboard material including, without limitation, single wall, double wall and/or triple wall corrugated cardboard material. However, it may be understood that other materials and variations of the illustrated shape may be provided within the scope of the packaging insert described and claimed herein. The blank 10 illustrated in FIG. 1 is a planar piece of material in which an inner side 12 is shown facing out of the page and an outer side 14, see FIG. 3, is facing an opposite direction from the inner side 12.

As seen in FIG. 1, the blank 10 extends in a lateral direction $L_1$ between first and second lateral edges, generally designated 16 and 18, respectively, and further extends in a longitudinal direction $L_2$ between first and second longitudinal edges, generally designated 20 and 22, respectively. The blank 10 comprises a main body panel 24 having a first lateral edge 24*a* and an opposing second lateral edge 24*b*. The main body panel 24 further includes a first longitudinal edge 24*c* coinciding with the first longitudinal edge 20 of the blank 10, and an opposing second longitudinal edge 24*d* coinciding with the second longitudinal edge 22 of the blank 10.

In accordance with one aspect of the described embodiment, the first longitudinal edge 20 can comprise an upper edge of the insert 8 and the second longitudinal edge 22 can comprise a lower edge of the insert 8. However, it should be understood descriptions of particular orientations of the insert 8 are provided for convenience in the present description and are not intended as being limiting to the structure or use of the present invention.

A first column panel 26 is connected to the first lateral edge 24*a* of the main body panel 24 along a respective first lateral score line $\mathbf{26}_1$, and a second column panel 28 is connected to the second lateral edge 24*b* of the main body panel 24 along a respective first lateral score line $\mathbf{28}_1$. The first column panel 26 includes a first side panel 30*a*, a front panel 32*a*, a second side panel 34*a*, and an overlap tab 36*a* connected in series at a second lateral score line $\mathbf{26}_2$, a third lateral score line $\mathbf{26}_3$, and a fourth lateral score line $\mathbf{26}_4$, respectively. Similarly, the second column panel 28 includes a first side panel 30*b*, a front panel 32*b*, a second side panel 34*b*, and an overlap tab 36*b* connected in series at a second lateral score line $28_2$, a third lateral score line $28_3$, and a fourth lateral score line $28_4$, respectively. The overlap tabs 36*a*, 36*b* define the lateral edges 16, 18 of the blank 10. The pair of column panels 26, 28 are configured to define structure for forming rectangular cornerposts or columns 40*a*, 40*b* adjacent to the opposing first and second lateral edges 24*a*, 24*b* of the main panel 24, see FIG. 3, as is described further below.

It may be noted that in the illustrated embodiment, the first lateral score lines $26_1$, $28_1$, the third lateral score lines $26_3$, $28_3$, and the fourth lateral score lines $26_4$, $28_4$ can each be formed as perforated and cut score lines that facilitate folding at these locations. Further, the second lateral score lines $26_2$, $28_2$ can be formed as machine scored lines that facilitate folding at these locations. It should further be understood that alternative score line configurations than those described herein can be provided at each of the fold locations between adjacent panels.

Referring to FIG. 1, each first side panel 30*a*, 30*b* has a lateral dimension $d_1$, from the first lateral score line $26_1$, $28_1$ to the respective second lateral score line $26_2$, $28_2$, and the lateral dimension $d_1$ of the first side panel 30*a*, 30*b* is equal to a lateral dimension $d_2$ of the second side panel 34*a*, 34*b*, from the third lateral score line $26_3$, $28_3$ to the respective fourth lateral score line $26_4$, $28_4$. The lateral dimension $d_1$, $d_2$ of the first and second side panels 30*a*, 30*b* and 34*a*, 34*b* defines a front to rear, or depth, dimension of the rectangular columns 40*a*, 40*b* of the erected packaging insert 8, see FIG. 3.

As further seen in FIG. 1, each front panel 32*a*, 32*b* includes a respective first longitudinal edge 42*a*, 42*b* that is longitudinally aligned with the first longitudinal edge 24*c* of the main body panel 24. A second longitudinal edge 44*a*, 44*b* of each respective front panel 32*a*, 32*b* is longitudinally displaced from alignment with the second longitudinal edge 24*d* of the main body panel 24 to define a first lower cut-out area $C_1$ between the respective first side panels 30*a*, 30*b* and second side panels 34*a*, 34*b*. Hence, each front panel 30*a*, 30*b* defines a longitudinally shortened panel wherein a longitudinal dimension $d_3$ of each front panel 30*a*, 30*b*, extending from the first longitudinal edge 42*a*, 42*b* to the second longitudinal edge 44*a*, 44*b*, is less than a longitudinal dimension do of the main body panel 24 extending between the first and second longitudinal edges 24*c*, 24*d* of the main body panel 24.

Each second side panel 34*a*, 34*b* includes a respective first longitudinal edge 46*a*, 46*b* that is longitudinally aligned with the first longitudinal edge 24*c* of the main body panel 24. A second longitudinal edge 48*a*, 48*b* of each respective second side panel 34*a*, 34*b* is longitudinally displaced from alignment with the second longitudinal edge 24*d* of the main body panel 24 to define a second lower cut-out area $C_2$ between respective front panels 32*a*, 32*b* and overlap tabs 36*a*, 36*b*. Hence, each second side panel 34*a*, 34*b* defines a longitudinally shortened panel wherein a longitudinal dimension $d_4$ of each second side panel 34*a*, 34*b*, extending from the first longitudinal edge 46*a*, 46*b* to the second longitudinal edge 48*a*, 48*b*, is less than the longitudinal dimension $d_0$ of the main body panel 24 and is greater than the longitudinal dimension $d_3$ of the front panel 24.

Figure 2:
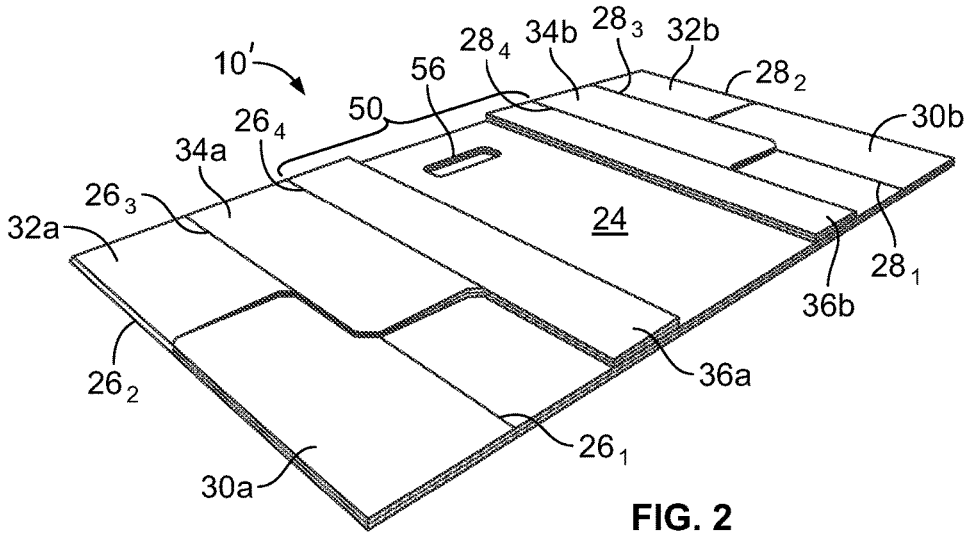
FIG. 2 is a perspective view of the blank of FIG. 1, folded and glued, to form a folded blank.

Referring to FIG. 2, the blank 10 can be formed into a folded packaging insert 10' prior to shipping to a customer for use in a packaging operation and, as noted above, the formation of the folded packaging insert can be performed on a flexo-folder-gluer machine (not shown). The present embodiment is described with reference to forming attachment points as a manufacturer's joint using an adhesive fastening or attachment between panels. However, it may be understood that other or alternative forms of attachment may be provided, such as staples or tape, and/or may include a mechanical interlock between panels as is described further below.

In a folding operation for forming the folded packaging insert 10' from the blank 10, a manufacturer's joint strip $S_1$ (FIG. 1), e.g., a strip of glue, may be formed extending longitudinally on the main panel 24 at two predetermined locations laterally spaced from the first lateral score lines $26_1$, $28_1$. In addition, or alternatively, a manufacturer's joint strip $S_2$ (FIG. 1), e.g., a strip of glue, may be formed extending longitudinally along each of the overlap tabs 36, 36*b*. An outer section of each column panel 26, 28 including the front panel 32*a*, 32*b*, the second panel 34*a*, 34*b*, and the overlap tab 36*a*, 36*b* is pivoted or folded about a respective second lateral score line $26_2$, $28_2$ to position the overlap tabs 36*a*, 36*b* in overlapping relation attached to the main body panel 24 at the respective manufacturer's joint strips $S_1$ and forming a pivot connection between the main body panel 24 and the second side panels 34*a*, 34*b*.

In the folded configuration of the blank 10, each front panel 32*a*, 32*b* is positioned in overlapping relation with a respective first side panel 30*a*, 30*b* and each second side panel 34*a*, 34*b* is positioned in overlapping relation with a portion of the main body panel 24 between the manufacturer's joint strip $S_1$ and a respective first lateral score line $26_1$, $28_1$. The folded packaging insert 10' defines a central panel section 50 on the main body panel 24 extending laterally between the fourth lateral score lines $26_4$, $28_4$, and the portions of the column panels 26, 28 laterally outward from the fourth lateral score lines $26_4$, $28_4$ are configured to form the rectangular columns 40*a*, 40*b* on either side of the central panel section 50.

Referring further to FIG. 3, the folded packaging insert 10' is formed into an erected packaging insert 8 by pivoting the first side panels 30*a*, 30*b* about the first lateral score lines $26_1$, $28_1$ such that the first side panels 30*a*, 30*b* are folded to a position that is generally perpendicular to the main body panel 24 to define first side walls 30*a*', 30*b*' for the rectangular columns 40*a*, 40*b*. Simultaneously, with pivoting of the first side panels 30*a*, 30*b*, the second side panels 34*a*, 34*b* are pivoted about the fourth lateral score lines $26_4$, $28_4$ such that the second side panels 34*a*, 34*b* are folded to a position that is generally perpendicular to main body panel 24 to define second side walls 34*a*', 34*b*' for the rectangular columns 40*a*, 40*b*. Pivoting of the first side panels 30*a*, 30*b* and second side panels 36*a*, 36*b* additionally positions the front panels 32*a*, 32*b* in spaced relation and parallel to a portion of the main body panel 24 to define front walls 32*a*', 32*b*' oriented perpendicular to the first and second side walls 30*a*', 30*b*' and 34*a*', 34*b*'. Back walls 52*a*', 52*b*' for the rectangular columns 40*a*, 40*b* are coplanar with the central panel section 50 and are defined by portions of the main body panel 24 that are facing the front walls 32*a*', 32*b*'. The first side walls 30*a*', 30*b*' of the erected insert 8 define lateral outer sides of the insert 8. The erected packing insert 8 is configured to be positioned within a shipping box with the longitudinal direction $L_2$, as defined for the blank 10, oriented vertically, as is described further below.

The lower insert edges defined by the second longitudinal edges 44*a*, 44*b* of the front panels 32*a*, 32*b* extend from the first side walls 30*a*', 30*b*' to the second side walls 34*a*', 34*b*', in a horizontal plane parallel to the longitudinal edges 24*c*, 24*d* of the main body panel 24. Further, the lower insert edges defined by the second longitudinal edges 48*a*, 48*b* of the second side panels 34*a*, 34*b* are vertically displaced from the lower insert edges defined by the second longitudinal edges 44*a*, 44*b* and extend from the front walls 32*a*', 32*b*' to the back walls 52*a*', 52*b*' in a horizontal plane that is parallel to the second longitudinal edges 44*a*, 44*b*.

Figure 4:
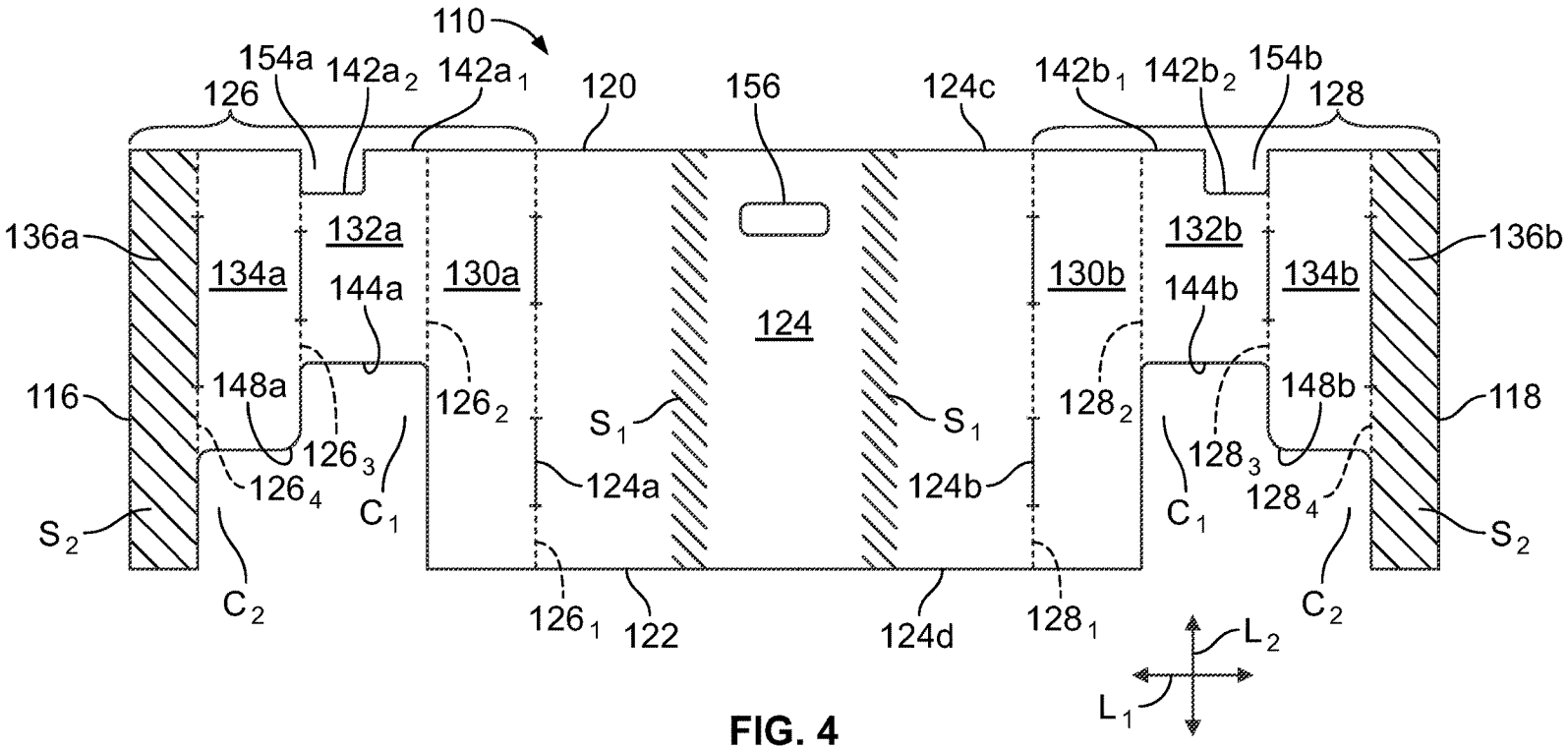
FIG. 4 is a plan view of an alternative configuration of a blank for forming a packaging insert.

FIG. 4 illustrates an alternative configuration for a blank 110 used to form the packaging insert in which front walls of the blank 110 are formed with slots, as is described in greater detail below. In the following description of FIG. 4, elements corresponding to similar elements of FIGS. 1-3 are labeled with the same reference numeral increased by 100.

As seen in FIG. 4, the blank 10 extends in a lateral direction $L_1$ between first and second lateral edges, generally designated 116 and 118, respectively, and further extends in a longitudinal direction $L_2$ between first and second longitudinal edges, generally designated 120 and 122, respectively. The blank 110 comprises a main body panel 124 having a first lateral edge 124*a* and an opposing second lateral edge 124*b*. The main body panel 124 further includes a first longitudinal edge 124*c* coinciding with the first longitudinal edge 120 of the blank 110, and an opposing second longitudinal edge 124*d* coinciding with the second longitudinal edge 122 of the blank 10.

A first column panel 126 is connected to the first lateral edge 124*a* of the main body panel 124 along a respective first lateral score line $\mathbf{126}_1$, and a second column panel 128 is connected to the second lateral edge 124*b* of the main body panel 124 along a respective first lateral score line $\mathbf{128}_1$. The first column panel 126 includes a first side panel 130*a*, a front panel 132*a*, a second side panel 134*a*, and an overlap tab 136*a* connected in series at a second lateral score line 1262, a third lateral score line $\mathbf{126}_3$, and a fourth lateral score line 1264, respectively. Similarly, the second column panel 128 includes a first side panel 130*b*, a front panel 132*b*, a second side panel 134*b*, and an overlap tab 136*b* connected in series at a second lateral score line $\mathbf{128}_2$, a third lateral score line $\mathbf{128}_3$, and a fourth lateral score line $\mathbf{128}_4$, respectively.

In addition, each of the front panels 132*a*, 132*b* includes a first longitudinal edge having a first portion $\mathbf{142}a_1$, $\mathbf{142}b_1$ that is longitudinally aligned with the first longitudinal edge 124*c* of the main body panel 124. The first longitudinal edge of each front panel 132*a*, 132*b* has a second portion $\mathbf{142}a_2$, $\mathbf{142}b_2$ that is longitudinally displaced from the first longitudinal edge 124*c* of the main body panel 124. Each of the second portions $\mathbf{142}a_2$, $\mathbf{142}b_2$ of the first longitudinal edges define respective front panel slots 154*a*, 154*b*. It may be noted that, although the front panel slots 154*a*, 154*b* illustrated in FIG. 4 extend from the third lateral score lines $\mathbf{126}_3$, $\mathbf{128}_3$ to approximately half the width of the front panels 132*a*, 132*b*, the lateral dimension, as well as the longitudinal dimension, of the front panel slots 154*a*, 154*b* may be greater or less than is shown herein.

As further seen in FIG. 4, each front panel 132*a*, 132*b* includes a respective second longitudinal edge 144*a*, 144*b* which is longitudinally displaced from alignment with the second longitudinal edge 124*d* of the main body panel 124 to define a first lower cut-out area $C_1$ between the respective first side panels 130*a*, 130*b* and second side panels 134*a*, 134*b*.

Each second side panel 134*a*, 134*b* includes a respective second longitudinal edge 148*a*, 148*b* which is longitudinally displaced from alignment with the second longitudinal edge 124*d* of the main body panel 124 to define a second lower cut-out area $C_2$ between respective front panels 132*a*, 132*b* and overlap tabs 136*a*, 136*b*.

The overlap tabs 136*a*, 136*b* define the lateral edges 116, 118 of the blank 110, and manufacturer's joint strips $S_1$ and $S_2$ can be formed on the main body panel 124 and overlap tabs 136*a*, 136*b*, respectively, wherein the overlap tabs 136*a*, 136*b* may be adhered to the main body panel 124 at the locations of the manufacturer's joint strips $S_1$. The pair of column panels 126, 128 are configured to define structure for forming rectangular cornerposts or columns 140*a*, 140*b* adjacent to the opposing first and second lateral edges 124*a*, 124*b* of the main panel 124 to define an erected packaging insert 108 (see FIG. 5) in a manner similar to that described for the packaging insert 8 erected from the blank 10. In particular, the first side panels 130*a*, 130*b*, front panels 132*a*, 132*b*, and second side panels 134*a*, 134*b* can be positioned in an erected configuration to form first side walls 130*a*', 130*b*', front walls 132*a*', 132*b*', second side walls 134*a*', 134*b*', and back walls 152*a*', 152*b*' on the erected packaging insert 108.

Figure 5:
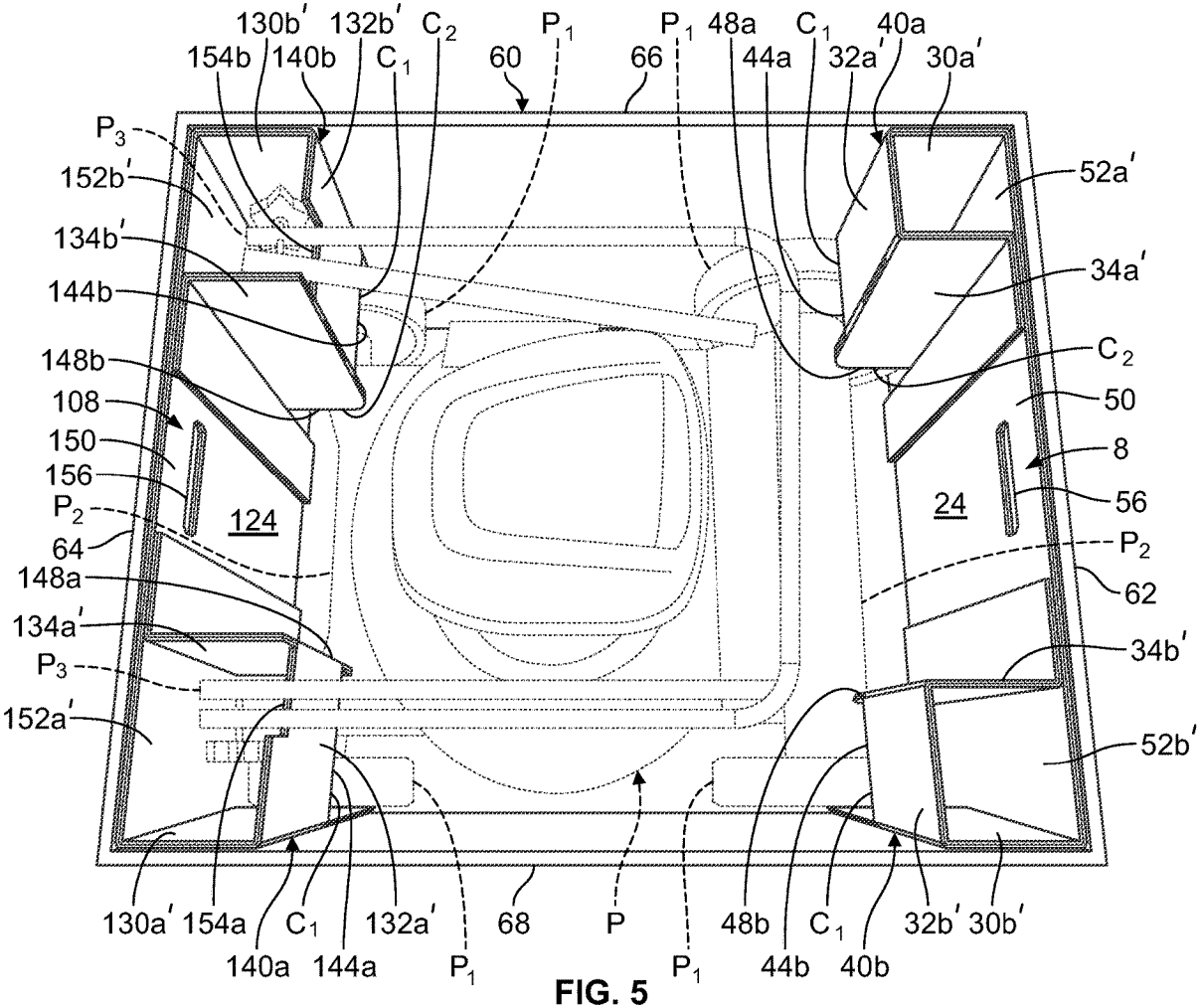
FIG. 5 is a perspective view of a shipping box including packaging inserts formed from the blanks of FIGS. 1 and 4 located within the shipping box.

Referring to FIG. 5, a box 60 for packaging a product, illustrated diagrammatically as a lawn mower P, is shown with the packaging insert 8 positioned as a front insert and the packaging insert 108 positioned as a rear insert. The front packaging insert 8 is located within the box 60 with the main panel body 24 extending the width of the box 60 adjacent to a first end wall 62 of the box 60, and with the first side walls 30*a*', 30*b*' of the rectangular columns 40*a*, 40*b* extending adjacent to respective side walls 66, 68 of the box 60. Similarly, the rear packaging insert 108 is located within the box 60 with the main panel body 124 extending the width of the box 60 adjacent to a second end wall 64 of the box 60, and with the first side walls 130*a*', 130*b*' of the rectangular columns 140*a*, 140*b* extending adjacent to respective side walls 68, 66 of the box 60.

The inserts 8, 108 can provide structural strength to the box 60 in a side-to-side direction between opposing side walls 66, 68. Further, the inserts 8, 108 are preferably formed with a longitudinal or vertical dimension, i.e., the main panel body longitudinal dimension do, that is equal to or approximately equal to the height dimension of the box 60, such that the rectangular columns 40*a*, 40*b* and 140*a*, 140*b* can provide structural reinforcement to the box 60 in the vertical direction. Also, the packaging inserts 8, 108 may be formed with a respective aperture 56, 156 that can align with respective apertures in the ends 62, 64 of the box 60 providing a hand hold for facilitating lifting of the box 60.

As can be further seen in FIG. 5, each of the cut-out areas $C_1$ associated with the front panels 32*a*, 23*b* and 132*a*, 132*b* can accommodate a wheel $P_1$ and an associated height adjuster for the mower P, wherein the second longitudinal edges 44*a*, 44*b* and 144*a*, 144*b*, defining lower front wall edges, can engage an upper surface of an adjacent wheel $P_1$ to facilitate retention of the mower P in position. Similarly, the cut-out areas $C_2$ associated with the second side panels 34*a*, 34*b* and 134*a*, 134*b* can accommodate a mower body portion $P_2$, e.g., a mower deck, of the mower P adjacent to the wheels $P_1$, wherein the second longitudinal edges 48*a*, 48*b* and 148*a*, 148*b*, defining lower second side wall edges, can engage an upper surface of the mower body portion $P_2$ to facilitate retention of the mower P in position. Further, the slots 154*a*, 154*b* in the front walls 132*a* 132*b* of the rear packaging insert 108 can accommodate a portion of a handle $P_3$ for the mower P to position and protect the handle $P_3$. Hence, the packaging inserts 8, 108 can be configured to engage various elements of the product, such as the wheels, mower deck, and handle elements, to support and maintain positions of the elements relative to the box during shipping.

From the above description, it may be understood that the central panel sections 50, 150 can be dimensioned to form the packaging inserts 8, 108 extending the full width of the box 60, with the rectangular columns 40*a*, 40*b* and 140*a*, 140*b* positioned at the corners of the box 60. the rectangular columns 40*a*, 40*b*, 140*a*, 140*b* of the packaging inserts 8, 108 provide a four-sided column structure at each of the corners of the box 60 for securely positioning a product, such as the illustrated mower P, and for resisting forces applied to the box 60, including either forces external to the box 60 or forces applied by the enclosed product during shipping in varying orientations and in the event that the box 60 is dropped.

It may be noted that the packaging inserts 8, 108 could be configured to extend along the sides 66, 68 in a direction extending between the opposing ends 62, 64 of the box 60. In such an alternative configuration, the cut-out areas $C_1$, $C_2$ could be formed with a height designed to accommodate the height of the product feature located in the particular cut-out area $C_1$, $C_2$.

It should also be noted that the packaging inserts 8, 108 may be formed with the overlap tabs 36*a*, 36*b* and 136*a*, 136*b* folded in an opposite direction than is illustrated in FIGS. 1 and 5. Additionally, it may be understood that the overlap tabs 36*a*, 36*b* and 136*a*, 136*b* may be attached to the respective main body panels 24, 124 by fastening mechanisms other than those specifically mentioned herein including, without limitation, staples and tape.

Figure 6:
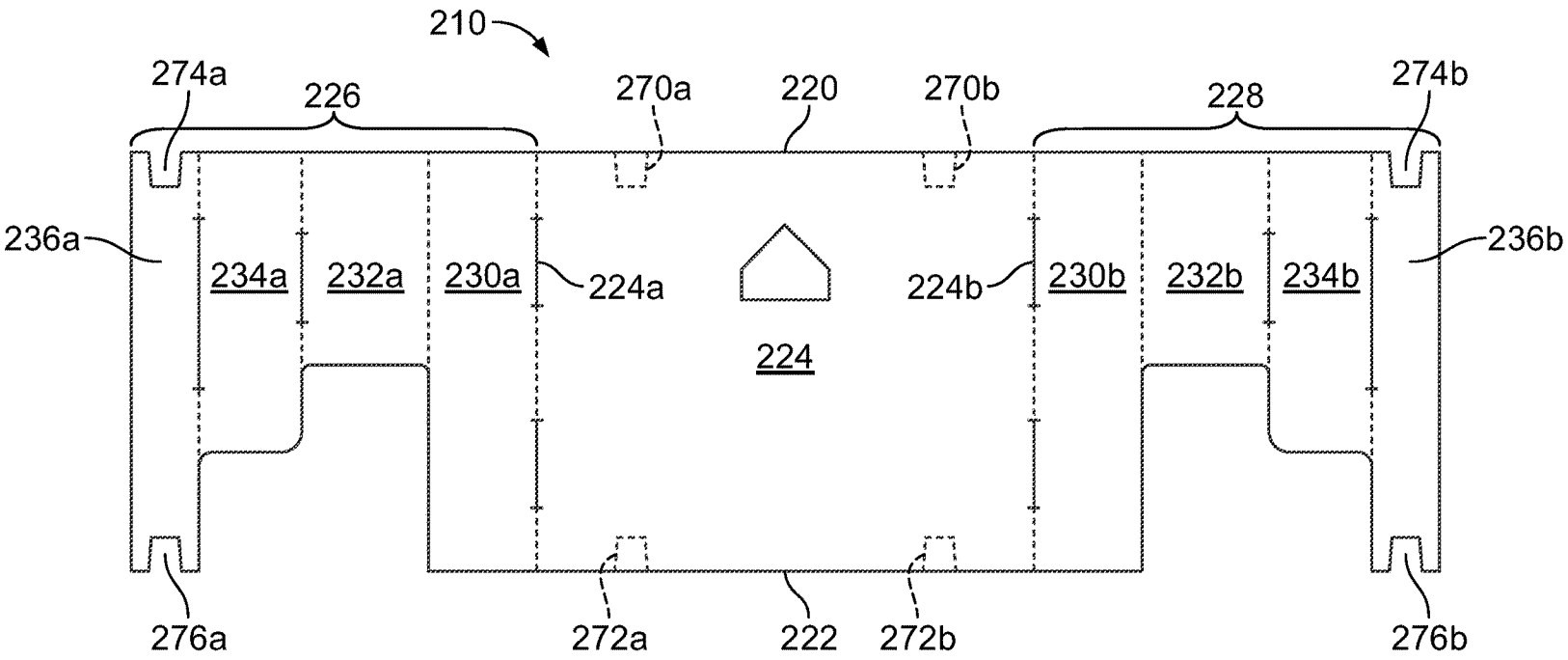
FIG. 6 is a plan view of an alternative configuration of a blank for forming a packaging insert.
Figure 7:
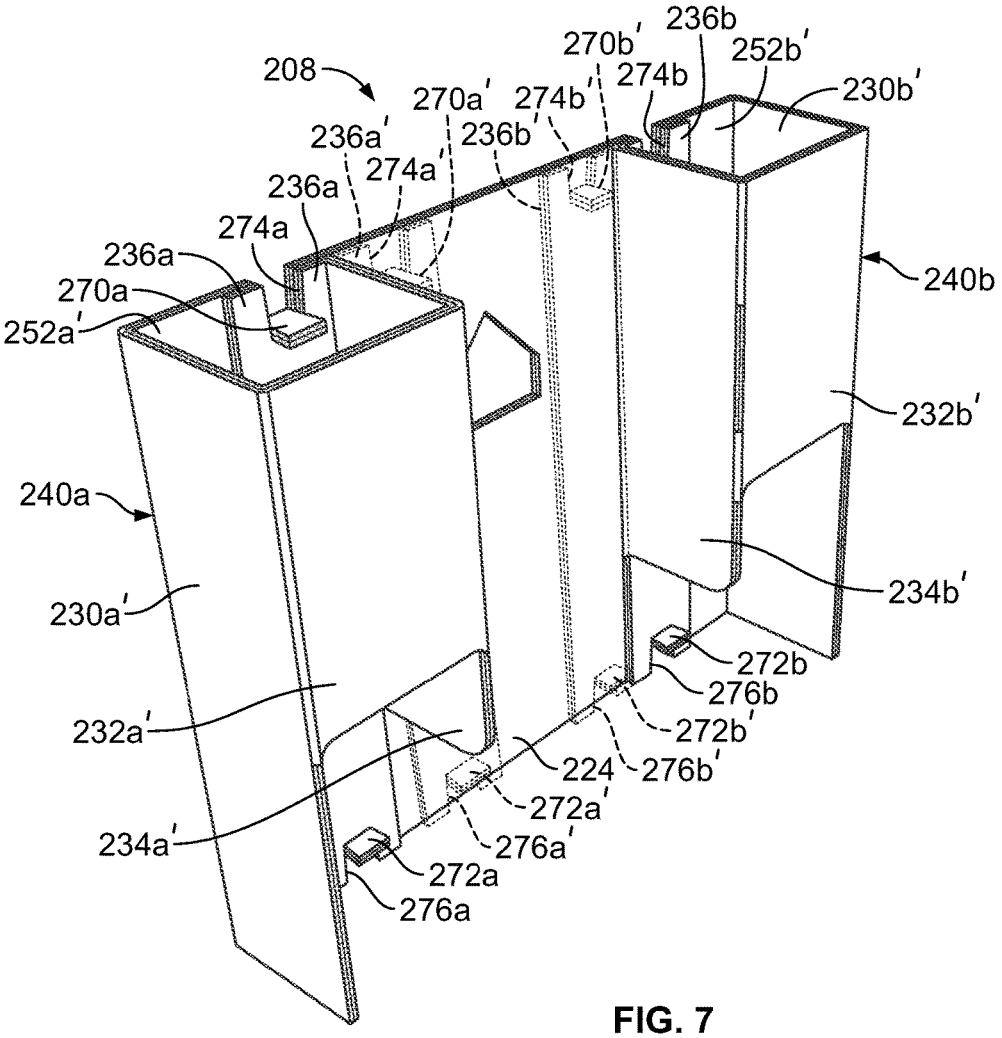
FIG. 7 is a perspective view of an erected packaging insert formed from the blank of FIG. 6.

Referring to FIGS. 6 and 7, a further alternative feature for forming the packaging inserts is illustrated by an alternative blank 210 and associated erected packaging insert 208. In the following description, elements corresponding to similar elements of FIGS. 1-3 are labeled with the same reference numeral increased by 200.

As seen in FIG. 6, the blank 210 includes a main body portion 224. A first column panel 226 is connected to a first lateral edge 224*a* of the main body panel 224, and a second column panel 228 is connected to a second lateral edge 224*b* of the main body panel 224. The first column panel 226 includes a first side panel 230*a*, a front panel 232*a*, a second side panel 234*a*, and an overlap tab 236*a* connected in series in the same manner as described for the blank 10 with reference to FIG. 1. Similarly, the second column panel 228 includes a first side panel 230*b*, a front panel 232*b*, a second side panel 234*b*, and an overlap tab 236*b* connected in series in the same manner as described for the blank 10 with reference to FIG. 1.

The main body panel 224 includes a pair of upper locking tabs 270*a*, 270*b* located at a first longitudinal edge 220 of the blank 210, and includes a pair of lower locking tabs 272*a*, 272*b* located at a second longitudinal edge 222 of the blank 210. Each of the locking tabs 270*a*, 270*b*, 272*a*, 272*b* may be formed of pairs of perforated lines or slits extending in from the edges 220, 222 of the blank 210.

The overlap tabs 236*a*, 236*b* are each formed with a respective upper locking cut-out 274*a*, 274*b* located at the first longitudinal edge 220, and are each formed with a respective lower locking cut-out 276*a*, 276*b* located at the second longitudinal edge 222. The locking cut-outs 274*a*, 274*b* and 276*a*, 276*b* are dimensioned to receive the respective upper and lower locking tabs 270*a*, 270*b* and 272*a*, 272*b*.

In a process forming the blank 210 into the packaging insert 208, as seen in FIG. 7, the column panels 226, 228 are folded forward, folding the first side panels 230*a*, 230*b* to a position perpendicular to the main body portion 224, folding the front panels 232*a*, 232*b* to a position perpendicular to the respective first side panels 230*a*, 230*b*, and folding the second side panels 234*a*, 234*b* to a position perpendicular to the respective front panels 232*a*, 232*b*. The second side panels 234*a*, 234*b* are attached to the main body panel 224 to form the rectangular columns 240*a*, 240*b*, comprising pivoting the overlap tabs 236*a*, 236*b* toward the interior of the rectangular columns 240*a*, 240*b* and locating the locking cut-outs 274*a*, 274*b*, 276*a*, 276*b* adjacent to the respective locking tabs 270*a*, 270*b*, 272*a*, 272*b*. The locking tabs 270*a*, 270*b*, 272*a*, 272*b* are folded into the respective locking cut-outs 274*a*, 274*b*, 276*a*, 276*b* to form a mechanical interlock for retaining the overlap tabs 236*a*, 236*b* in attached overlapping relationship on the main body panel 224. The rectangular columns 240*a*, 240*b* of the packaging insert 208 are formed to include respective first side walls 230*a*', 230*b*', front walls 232*a*', 232*b*', second side walls 234*a*', 234*b*' and back walls 252*a*', 252*b*', wherein the overlap tabs 236*a*, 236*b* extend along a portion of the back walls 252*a*', 252*b*'.

FIG. 7 further shows an alternative position for the overlap tabs 236*a*, 236, as illustrated by dotted line elements 236*a*', 236*b*'. In particular, locking tabs 270*a*', 270*b*', 272*a*', 272*b*' can be located at alternative positions on the main body panel 224 that are laterally inward of the second side walls 234*a*', 234*b*'. The overlap tabs 236*a*', 236*b*' are folded relative to the second side walls 234*a*', 234*b*' in a direction opposite from the direction described above for attaching the overlap tabs 236*a*, 236*b*. The locking tabs 270*a*', 270*b*', 272*a*', 272*b*' can be folded into the respective locking cut-outs 274*a*', 274*b*', 276*a*', 276*b*' formed in the overlap tabs 234*a*', 234*b*' to define an attachment between the second side walls 234*a*', 234*b*' and the main body panel 224 via the overlap tabs 234*a*', 234*b*'.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A packaging insert formed from a blank including a main body panel, a pair of column panels connected to the main body panel along respective first lateral score lines, each column panel including a first side panel, a front panel, and a second side panel connected in series at respective second and third lateral score lines, the packaging insert comprising:

a central panel section defined by the main body panel;

first and second rectangular columns defined by the column panels at opposing lateral sides of the central panel section, each rectangular column including:

a back wall formed by a portion of the main body panel;

a first side wall defined by the first side panel folded generally perpendicular to the main body panel at the respective first lateral score line;

a front wall defined by the front panel folded generally perpendicular to the first side wall at the respective second lateral score line; and a second side wall defined by the second side panel folded generally perpendicular to the front wall at the respective third lateral score line and connected to the main body panel;

wherein the main body panel has a first longitudinal edge and an opposed second longitudinal edge defining a longitudinal dimension of the packaging insert, the front wall has opposed first and second longitudinal edges extending parallel to the longitudinal edges of the main body panel, and the second longitudinal edge of the front wall extends laterally from the first side wall to the second side wall and is longitudinally displaced from the second longitudinal edge of the main body panel.

2. The packaging insert as set forth in claim 1, wherein the back wall of each rectangular column is coplanar with the central panel section.

3. The packaging insert as set forth in claim 1, further including an overlap tab connected to each of the second side panels at respective fourth lateral score lines, each overlap tab fastened to a location on the main body panel.

4. The packaging insert as set forth in claim 1, wherein the central panel section has a lateral dimension that is defined by a portion of the main body panel extending from the second side wall of the first rectangular column to the second side wall of the second rectangular column.

5. The packaging insert as set forth in claim 1, wherein the second side wall of each rectangular column has opposed first and second longitudinal edges, and the second longitudinal edge of the second side wall is longitudinally displaced from the second longitudinal edge of the main body panel and is longitudinally displaced from the second longitudinal edge of the front wall.

6. A blank for forming a one-piece packaging insert comprising:

a main body panel having a first longitudinal edge defining a first longitudinal edge of the blank and an opposing second longitudinal edge defining a second longitudinal edge of the blank, and opposing first and second lateral edges;

a pair of column panels connected to the main body panel along respective first lateral score lines, each column panel defining structure for forming a rectangular column adjacent to the opposing first and second lateral edges of the main body panel; and each column panel including a first side panel, a front panel, and a second side panel connected in series along respective second and third lateral score lines;

wherein each front panel includes a longitudinal dimension extending from a first longitudinal edge to a second longitudinal edge, the second longitudinal edge of the front panel extending laterally from the first side panel to the second side panel, and the longitudinal dimension of each front panel is less than a longitudinal dimension of the main body panel extending between the first and second longitudinal edges of the main body panel.

7. The blank as set forth in claim 6, including an overlap tab connected to each of the second side panels at respective fourth lateral score lines, each overlap tab defining a lateral edge of the blank.

8. The blank as set forth in claim 7, wherein each first side panel has a lateral dimension, from the first lateral score line to the second lateral score line, and the lateral dimension of the first side panel is equal to a lateral dimension of the second side panel, from the third lateral score line to the fourth lateral score line.

9. The blank as set forth in claim 6, wherein at least a portion of the first longitudinal edge of each front panel is longitudinally aligned with the first longitudinal edge of the main body panel, and the second longitudinal edge of each front panel is longitudinally displaced from alignment with the second longitudinal edge of the main body panel.

10. The blank as set forth in claim 6, wherein at least a portion of each of the first and second longitudinal edges of each front panel is longitudinally displaced from the respective first and second longitudinal edges of the main body panel, the longitudinally displaced portions of the first longitudinal edge of the front panels defining slots in the front panels, the slots extending from the first longitudinal edge of the main body panel.

11. The blank as set forth in claim 6, wherein each second side panel includes a longitudinal dimension extending from a first longitudinal edge to a second longitudinal edge, and the longitudinal dimension of each second side panel is less than the longitudinal dimension of the main body panel and is greater than a longitudinal dimension of the front panel.

12. The blank as set forth in claim 6, wherein each second side panel includes a longitudinal dimension extending from a first longitudinal edge to a second longitudinal edge, and the longitudinal dimension of each second side panel is less than a longitudinal dimension of the main body panel extending between the first and second longitudinal edges of the main body panel.

13. The blank as set forth in claim 12, wherein the first longitudinal edge of each second side panel is longitudinally aligned with the first longitudinal edge of the main body panel, and the second longitudinal edge of each second side panel is longitudinally displaced from alignment with the second longitudinal edge of the main body panel.

14. A folded blank for forming a packaging insert, the folded blank comprising:

a one-piece blank including a main body panel having opposing first and second longitudinal edges and opposing first and second lateral edges;

a pair of column panels, each column panel including a first side panel, a front panel, a second side panel, and an overlap tab connected to the main body panel in series at first, second, third, and fourth lateral score lines; and the front panel of each column panel is folded about a respective second lateral score line with the overlap tab overlapping and attached to the main body panel;

wherein each front panel includes a longitudinal dimension extending from a first longitudinal edge to a second longitudinal edge, the second longitudinal edge of the front panel extending laterally from the first side panel to the second side panel, and the longitudinal dimension of each front panel is less than a longitudinal dimension of the main body panel extending between the first and second longitudinal edges of the main body panel.

15. The folded blank as set forth in claim 14, wherein each front panel is positioned in overlapping relation with a respective first side panel and each second side panel is positioned in overlapping relation with a portion of the main body panel.

16. The folded blank as set forth in claim 14, wherein each overlap tab is adhered to a manufacturer's joint strip defined on the main body panel.

17. The folded blank as set forth in claim 14, wherein each second side panel includes a longitudinal dimension extending from a first longitudinal edge to a second longitudinal edge, and the longitudinal dimension of each second side panel is less than the longitudinal dimension of the main body panel and is greater than the longitudinal dimension of the front panel.

* * * * *